United States Patent [19]

Brooks

[11] Patent Number: 5,014,912

[45] Date of Patent: May 14, 1991

[54] DEVICE FOR DISPLACING A SUBMERGED ARTICLE

[75] Inventor: David A. Brooks, Roodepoort, South Africa

[73] Assignee: Oakleigh, Ltd., St. Peter's Port, Channel Islands

[21] Appl. No.: 279,535

[22] Filed: Dec. 5, 1988

[30] Foreign Application Priority Data

Dec. 3, 1987 [ZA] South Africa ..... 87/9088

[51] Int. Cl.[5] ..... B05B 3/14; B05B 17/04

[52] U.S. Cl. ..... 239/11; 134/167 R; 239/229; 239/381; 239/246; 239/447; 440/40

[58] Field of Search ..... 239/99, 101, 229, 380, 239/381, 382, 383, 447, DIG. 13, 246, 1, 11; 440/40, 38; 134/167 R

[56] References Cited

U.S. PATENT DOCUMENTS

| | | | |
|---|---|---|---|
| 3,074,078 | 1/1963 | Varian | 239/229 |
| 3,392,738 | 7/1968 | Pansini | 134/167 |
| 3,776,464 | 12/1973 | Proffit | 239/229 |
| 3,820,172 | 6/1974 | Kane | 134/167 R |
| 4,089,471 | 5/1978 | Koenig | 239/381 |
| 4,100,641 | 7/1978 | Pansini | 15/1.7 |
| 4,169,484 | 10/1979 | Bonigut | 134/167 R |
| 4,361,282 | 11/1982 | DiVito | 239/DIG. 13 |
| 4,686,728 | 8/1987 | Rawlings | 15/1.7 |
| 4,783,007 | 11/1988 | Schafer | 239/381 |

FOREIGN PATENT DOCUMENTS 3239009 4/1984 Fed. Rep. of Germany ..... 239/447

*Primary Examiner*—Andres Kashnikow
*Assistant Examiner*—Michael J. Forman
*Attorney, Agent, or Firm*—Baker & McKenzie

[57] ABSTRACT

A displacing device for a swimming pool cleaner has a hollow housing with a cylindrical wall and end walls. Within the housing are two spaced partitions which divide the interior of the housing into three chambers. A first and second chamber have openings in the cylindrical wall with jet nozzles projecting therefrom. A ball is located in each of the first and second chambers which close off one opening at a time so that water then flows out of the or each other opening that is open. One end wall and the partitions each have an aperture in which a tube is slidable. The tube has holes so that water fed into the tube at one end flows through the tube and out through the holes into the first or the second chamber, depending on the position of the tube. The tube is moved up and down by an engine that does not form part of this invention. The outer end wall has a connector for connection to a source of pressurized water. This end wall is adjacent the third chamber and an outlet port is provided in the cylindrical wall of the third chamber to supply pressurized water to the pool cleaner. The tube is also rotatable and at its end adjacent the connector vanes.

17 Claims, 1 Drawing Sheet

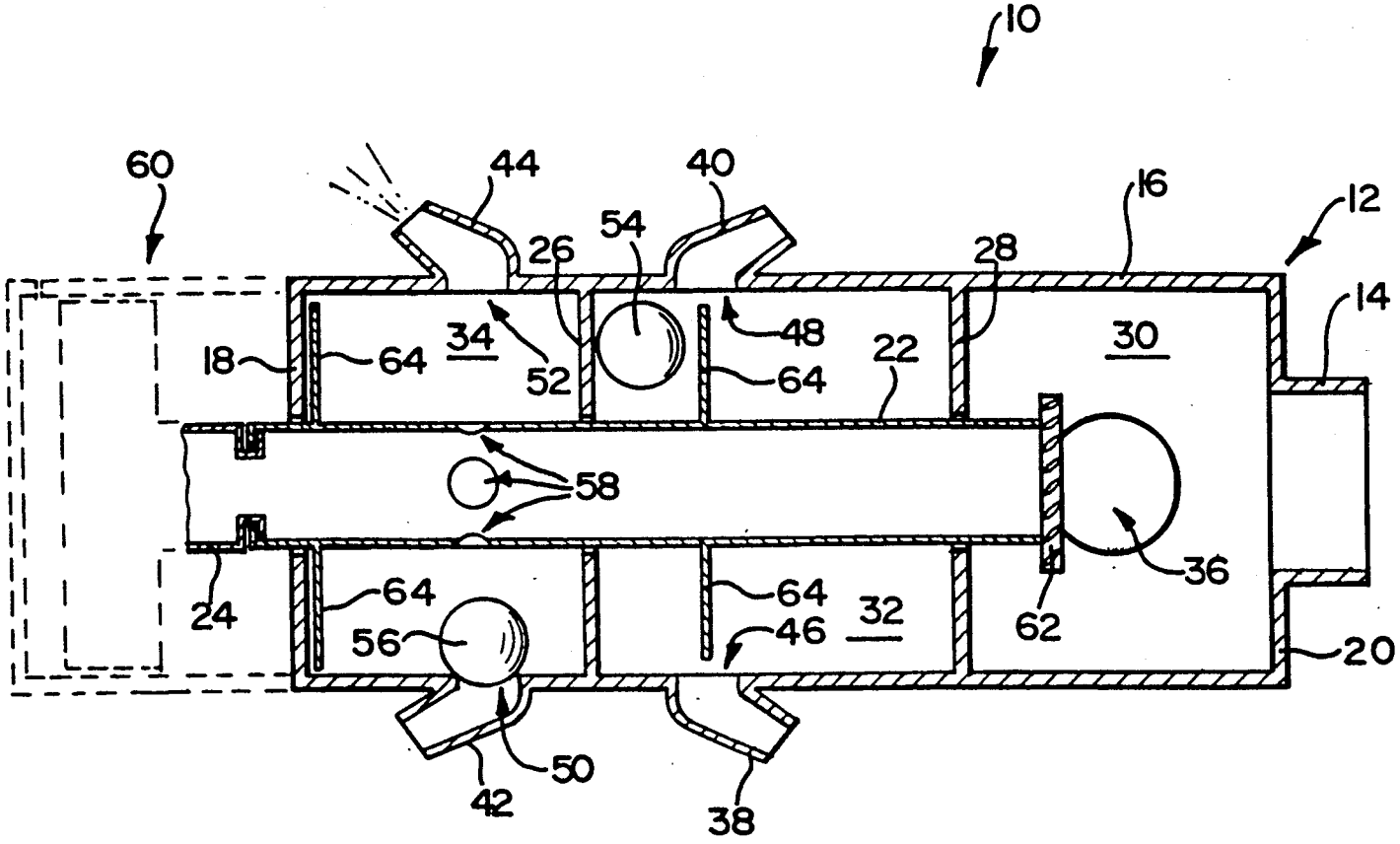
10
12
14
16
18
20
22
24
26
28
30
32
34
36
38
40
42
44
46
48
50
52
54
56
58
60
62
64

DEVICE FOR DISPLACING A SUBMERGED ARTICLE

BRIEF SUMMARY OF THE INVENTION

This invention relates to a device for displacing an article in a liquid, in particular a swimming pool cleaner.

According to the invention there is provided a displacing device for displacing an article in a liquid, which includes a hollow housing which defines a chamber;

a connection means for connecting the housing to a source of pressurised liquid for delivering pressurised liquid into the chamber;

a plurality of outlet openings defined in the housing for permitting the flow of liquid out of the chamber; and a closing means for periodically closing the outlets so that at least one is open and the or each other outlet is closed, in a substantially random manner.

The outlets may be connected to components, such as turbines which convert liquid flow to mechanical movement, or to jet defining members.

The closing means may comprise at least one ball or other object within the housing, which is displaced, in a substantially random manner, into closing engagement with the entrance to one of the outlet openings (or more if there is more than one ball).

The outlet openings may be arranged in groups, there being at least one ball for each group. It will be understood that with each group there will be at least one less ball than there are outlet openings in that group. Further, a valve arrangement may be provided to supply the pressurised liquid alternately to the various groups. The valve arrangement may be movable to supply the liquid to the groups in a cyclical manner. The valve arrangement may include a slidable and rotatable member.

In addition a displacing means may be provided to displace the or each ball from the outlet opening(s) in a particular group with which it/they are engaged, when the valve arrangement stops supplying liquid to that particular group of outlet openings.

In a preferred embodiment, which has jet defining members, some of the jet defining members may face in a forward direction and some in a backward direction. Further, the jet defining members may be angled so as to provide a sideways thrust component in addition to a forward or backward component.

BRIEF DESCRIPTION OF THE DRAWING

The invention is now described, by way of an example, with reference to the accompanying drawing, which shows schematically a displacing device in accordance with the invention.

DETAILED DESCRIPTION

Referring to the drawing, a device for displacing a swimming pool cleaner is designated generally by reference numeral 10. The device 10 has a hollow housing 12 that has a connecting portion 14 at one end whereby it may be connected to a source of pressurized water (not shown). Further, the housing 12 has a cylindrical wall 16 with two end walls 18 and 20. The connecting portion projects from the end wall 20.

The connecting portion 14 is centrally located and is aligned with a tube 22 that is slidable towards and away from the connecting portion 14. The tube 22 is axially connected to a further tube 24 at its end remote from the connecting portion 14, so that the tube 22 is rotatable relative to the tube 24. As is clear from the drawing, the further tube 24 extends through an opening in the end wall 18 and is slidable therein.

The interior of the housing 12 is divided into three chambers by two annular partitions 26 and 28. Thus, there is a first chamber 30 which is located between the partition 28 and the end wall 20, a chamber 32 between the partitions 26 and 28 and a chamber 34 between the partition 26 and the end wall 18.

An aperture 36 is provided in the cylindrical wall 16, in the region of the chamber 30, through which water may flow to perform a cleaning function. Four jet nozzles 38, 40, 42 and 44 are fast with the cylindrical wall 16, about openings 46, 48, 50 and 52, respectively. As will be noted from the drawing, the nozzles 38 and 40 communicate with the chamber 32 and are directed in a backward direction, and the nozzles 42 and 44 communicate with the chamber 34 and are directed in a forward direction. All of the nozzles 38 to 44 are angled so that water issuing therefrom will exert a thrust on the housing 12 which has both a sideways component and a forward or backward component.

Within the chamber 32 there is a ball 54 and within the chamber 34 there is a ball 56. The ball 54 seats in either the opening 46 or the opening 48 and the ball 56 seats in either the opening 50 or 52.

The tube 22 has outlet orifices 58 through which water flows into either the chamber 34 or the chamber 32, depending on the position of the tube 22 which is displaced back and forth by the tube 24. The tube 24, in turn, is displaced backwards and forwards by a unit 60 which is shown in dotted lines and which does not form part of the present invention. The unit 60 is operated by water flow, which is supplied to it via the tube 24. A suitable unit is described in our co-pending application filed at the same time as this application and entitled "A Fluid Operalbe Engine".

The tube 22 has at its free end, i.e. its end closest to the wall 20, a turbine wheel 62. It will be appreciated that when the tube 22 is at the limit of its stroke at which it is closest to the connecting portion 14, water flowing past the turbine wheel 62 will cause it to rotate, thereby rotating the tube 22. As the tube 22 is rotated slightly with each stroke, the relative orientation of the orifices 58 with reference to the openings 46 to 52 varies thereby inhibiting a particular pattern.

It will further be appreciated that when the tube 22 is in such a position that the orifices 58 communicate with the chamber 34, water flows through these orifices 58 and into the chamber 34. Depending on the position of the ball 56 at the time when flow begins, either the opening 50 or the opening 52 will be blocked. Thus, water will then issue either through the jet 42 or 44. When the tube 22 is displaced from left to right, when looking at the drawing, the orifices 58 will then pass into communication with the chamber 32 and the ball 54 will block either the opening 46 or 48 so that water issues either through the jet 38 or the jet 40. When water is being supplied to the chamber 32, the ball 56 will no longer be held in seating engagement with the opening 42 or 44 that it had closed, and it will move to some position in the chamber 34. Thus, as the tube 22 moves back and forth, rotating slightly with each stroke, the balls 54 and 56 close the openings 46 to 52 in a substantially random manner. Thus, although the device 10 experiences an alternate forward and backward thrust, it also experiences a substantially random sideways thrust. Thus, the device 10 is moved forwards and backwards in a predetermined manner and randomly in a sideways manner.

In order to ensure that the balls 54 and 56 are dislodged, pins 64 are provided that are fast with the tube 22 and which dislodge the balls 54 and 56 upon movement of the tube 22.

It will be appreciated that the invention provides a device whereby a pool cleaner may be displaced, which is cheap to manufacture, is reliable in operation and which moves in a predetermined but nonetheless random manner.

I claim:

1. A device for displacing a swimming pool cleaner in a body of water, comprising:

a hollow housing having a cylindrical side wall and opposite end walls, said housing having an inlet therein for connection to a source of pressurized water for delivery to the interior of the housing;

partition means within the housing dividing the interior thereof transversely into at least two chambers;

means forming at least two outlets for each of said chambers for receiving a flow of pressurized water from the inlet;

jet defining members on said housing communicating with said outlets to receive water therefrom, said jet defining members being directed in various selected directions outside said housing to cause water issuing therefrom to exert thrusts on the housing in different selected directions;

means for randomly closing and opening the outlets from each of said chambers including at least one displaceable member in each chamber engageable with each outlet to block the flow of water through the outlet, the number of displaceable members in each changer being at least one less than the number of outlets;

means for alternating the flow of water from said inlet between said chambers, and including a flow member movable back and forth in said housing relative to said partition means;

and means for disengaging the displaceable member in one of the chambers from the outlet in that chamber while the flow of water is directed to the other of said chambers, whereby the displaceable member in said one of the chambers will be re-engaged randomly with one of the outlets in said one of the chambers when the water flow is restored to said one of the chambers.

2. A device as defined in claim 1 wherein said means for alternating the flow of water between said chambers includes a linearly displaceable flow directing member that is supported in said housing for back and forth movement relative to said partition means between displaced first and second positions, said flow directing member defining a flow passage having an inlet end communicating with the housing inlet to receive pressurized water therefrom, and at least one outlet orifice positioned along said flow directing member to move back and forth through said partition means and between said chambers as said flow directing member moves back and forth between said first and second positions, thereby to direct the flow alternately between said chambers.

3. A device as defined in claim 2 wherein said flow directing member is an elongated hollow rod that is rotatably and slidably mounted in said partition means and has an open end positioned adjacent the inlet to receive the flow of water therefrom, and having a plurality of outlet orifices around the rod in an annular series.

4. A device as defined in claim 3 further including drive means on said rod for rotating the rod relative to the housing in response to the flow of water therein, thereby to vary the angular positions of the outlet orifices within the chambers.

5. A device as defined in claim 4 wherein the drive means comprises a water turbine on said open end of said rod.

6. A device as defined in claim 2 wherein said means for disengaging said displaceable members comprises disengaging elements on said flow directing member movable back and forth past said outlets to dislodge the ball in one chamber from an outlet when the outlet orifice is in the other chamber.

7. A device as defined in claim 1 wherein the jet defining means include four jet nozzles that are positioned at angles relative to the housing, two of said nozzles being inclined laterally outwardly and in the direction of one end of the housing, and two of the nozzles being inclined laterally outwardly and in the direction of the other end of the housing.

8. A device for displacing a swimming pool cleaner in a body of water comprising a housing defining a flow chamber having an inlet for receiving a flow of pressurized water, and a plurality of outlets;

jet defining means on said outlets for directing flows of water therefrom in different selected directions, thereby to develop thrust on said housing in different directions;

flow directing means for directing the flow of water into and away from the chamber;

means for randomly closing and opening said outlets including at least one displaceable member in said chamber engageable with one of the outlets to block the flow of water therethrough, the number of displaceable members being at least one less than the number of outlets whereby at least one outlet is left open to develop thrust from that outlet;

and means movable within the chamber for contacting the at least one displaceable member and for disengaging the at least one displaceable member from the outlets when the flow is directed away from said chamber.

9. A displacing device for moving through a pool of liquid with a randomly directed motion, which includes:

a hollow housing which defines at least two chambers, the housing having an inlet in fluid communication with the chambers;

a connection means for connecting the inlet to a source of pressurized liquid;

a first group of at least two outlets defined in the housing so as to direct the pressurized liquid from one of the chambers to the exterior of the displacing device in at least two different directions;

a second group of at least two outlets defined in the housing so as to direct the pressurized liquid from a second of the chambers to the exterior of the displacing device in at least two different directions;

a closing means for intermittently closing the outlets in a substantially random manner, including a first object associated with the first of said group of outlets and a second object associated with the second of said group of outlets, said first and second objects being cooperatively shaped with respect to each of the outlets in their respective groups so as to restrict flow of the pressurized liquid from the chamber through a given outlet when placed in a blocking position relative thereto, the objects being displaceably mounted within the housing for movement toward and away from the blocking position with respect to each of the outlets in their respective groups.

10. The device claimed in claim 9, further comprising a valve mounted in the housing between the inlet and each of the chambers so as to direct flow of the pressurized liquid from the inlet to the chambers alternately in response to a control input.

11. The device claimed in claim 10, in which the valve includes a linearly displaceable flow directing means for directing flow of the pressurized liquid.

12. The device claimed in claim 11, in which the flow directing means is also rotatably displaceable.

13. The device claimed in claim 12, further comprising means responsive to flow of the pressurized liquid for rotating the flow directing means.

14. A displacing device for moving through a pool of liquid with a randomly directed motion, which includes:

a hollow housing which defines at least two chambers, the housing having an inlet in fluid communication with the chambers;

a connection means for connecting the inlet to a source of pressurized liquid;

each of said chambers having at least two outlets defined in said housing so as to direct the pressurized liquid from the chamber to the exterior of the displacing device in at least two different directions;

each of the outlets comprising a jet defining member that is fast with the housing and communicates with its respective chamber to receive a flow of pressurized liquid therefrom and direct the flow out of the housing to produce a displacing force in a selected direction;

a closing means for intermittently closing the outlets in a substantially random manner, comprising a ball in each of the chambers displaceable between the outlets therein, each ball being operable to close the outlets of its respective chamber, one at a time; and a valve mounted in the housing between the inlet and each of the chambers so as to direct the flow of the pressurized liquid from the inlet to the chambers alternately in response to a control input.

15. The device claimed in claim 14, in which the valve includes a flow directing means mounted in the housing between the chambers for directing flow of the pressurized liquid to the chambers.

16. A method for moving an article through a pool of liquid with a randomly directed motion, comprising the steps of:

providing the article with a hollow housing which defines at least two chambers, the housing having an inlet in fluid communication with the chambers, and each of the chambers having at least two outlets defined therein so as to direct pressurized fluid from the chamber to the exterior of the article in at least two different directions;

connecting the inlet to a source of pressurized fluid capable of moving about the pool with the article;

alternately directing the pressurized liquid from the inlet to each of the chambers; and intermittently closing the outlets of each of said chambers in a substantially random manner.

17. A method as set forth in claim 16, wherein the alternately directing step is performed by a valve mounted in the housing between the two chambers, and further comprising the step of:

rotating the valve, in response to the flow of pressurized fluid from the inlet to the chambers, so as to change the direction from which the pressurized fluid enters the chambers during successive iterations of the alternately directing step.

* * * * *